US006386975B1

(12) United States Patent
Peterson

(10) Patent No.: US 6,386,975 B1
(45) Date of Patent: May 14, 2002

(54) WAGERING GAME AND SYSTEM FOR ITS IMPLEMENTATION

(76) Inventor: Vernon J. Peterson, 607 Rolling Hills Rd., Vista, CA (US) 92083-0948

( * ) Notice: Subject to any disclaimer, the term of this patent is extended or adjusted under 35 U.S.C. 154(b) by 0 days.

(21) Appl. No.: 09/566,762

(22) Filed: May 8, 2000

(51) Int. Cl.[7] ..... A63F 13/00

(52) U.S. Cl. ..... 463/16; 463/21; 463/22; 463/42

(58) Field of Search ..... 463/16–20, 25, 463/29, 22, 23, 42

(56) References Cited

U.S. PATENT DOCUMENTS 5,935,001 A * 8/1999 Baba ..... 463/18
6,024,641 A * 2/2000 Sarno ..... 463/17
6,210,276 B1 * 4/2001 Mullins ..... 463/27
6,270,407 B1 * 8/2001 Dodge ..... 463/18
6,277,025 B1 * 8/2001 Margolin ..... 463/18
6,283,855 B1 * 9/2001 Bingham ..... 463/12
6,306,038 B1 * 10/2001 Graves et al. ..... 463/40

* cited by examiner

*Primary Examiner*—Jessica Harrison
*Assistant Examiner*—John M Hotaling, II

(57) ABSTRACT

Multi-round game played on survivor principle. Survivor of each round enters succeeding round until one survivor remains. Retirees from each round may enroll in subsidiary game, the number of such games being defined by the number of positions in the set of symbols with which the games is played, e.g., a five-position set of symbols allows one primary game and four subsidiary games, all of which are governed by the same symbol-selection sequence. Each symbol-set which is active to the final selection is eligible to enroll in a summary game, in which a single winning symbol-set may receive a major jackpot, or all players may share in division of the jackpot. Implementation of the game involves data processing means for game-hosting and accounting purposes; and varied communication means for interaction between all parties.

13 Claims, 3 Drawing Sheets

WAGERING GAME AND SYSTEM FOR ITS IMPLEMENTATION

BACKGROUND

1. Field of the Invention

The present invention relates generally to gambling and games of skill and chance, and more specifically to a game involving a survival principle; and to a system which facilitates the implementation of the game on a very broad basis. The game involves multiple payouts for which players may vie with a combination of persistence, luck and skill, although any one of these qualities may suffice to win. Each game and the subsidiary games which proceed from it are controlled by a central authority whose writ may be narrow or broad in scope for a particular game. Jackpots are so structured that any player who persists through the course of the game has on opportunity to participate in a final payout.

2. Discussion of Prior Art

Wagering games are a popular form of entertainment, involving excitement and pleasure and featuring the possibility of gain, sometimes great gain. But existing games have certain characteristics which limit their appeal in a fast-paced world, defined by such capabilities as rapid data processing and instant communications. The present invention is as far beyond such games as slot machines and bingo than a computer-driven play station is beyond a pinball machine.

Most wagering games offered today were originally developed for play in casinos or similar specialized venues. While some, notably lotteries, have incorporated certain modern features to increase the size of their player pools, no wagering games have been designed specifically to exploit current technology. The contrast between the capabilities utilized in game arcade machines and in consumer games played on the internet, and those played in casinos, is stark. The arcade games are fast-paced, with heavy player involvement, great variation during play, and are responsive to players' actions.

Current wagering games are driven by the need to maintain player and cash turnover, a need that they meet by implementing simple rules of play and use of quick, singular decisions. One pull of the lever on a slot machine determines win or lose, and there is little drama or suspense in watching the sequential display of a winning combination. The only element typically within the player's control is the amount of his wager, and this is usually fixed when made.

Even when the game allows the player to make choices other than the size of his bet, he is required to make singular and immutable choices, such as picking a string of numbers in keno. He has no means to assess the state of play and, for example, to cash in while he is ahead and the game is still in play; or to wager on the prospects of other players' holdings.

Current games also lack continuity. A winner is decided quickly and then a new game is begun. There are no machanisms for building on the result of a game, to create "subsidiary" games or even hierarchies of games, the course of which relies on the outcome of predecessor games. There is no mechanism providing for these games' evolution toward an entertaining and rewarding climax.

Another feature typically lacking in current wagering games is player-to-player interaction. There is no mechanism for players to selectively share ownership of, for example, a lottery number (except privately); or to place a pari-mutuel bet on a slot machine revolution; and indeed such a participatory element would be seen as alien to the logic of current games.

Present wagering games are venue-dependent: They require the physical presence of the player, or the use of dedicated means to place a wager. This limits the player-pool and renders frequent play inconvenient. It means that a significant fraction of the players will be "impulse-buyers", who will play when the opportunity presents itself rather than seeking out a venue. This is partially solved by placing dedicated terminals and slot machines in well-frequented locations such as shopping malls and grocery stores, and by such expedients as bussing players to casinos, but these measures are not the same as providing instant access to a game of the player's choice.

The size of the player pool, or the quantity of enrollments in a given game, is essentially fixed once a game in underway. Current games are not scalable, except in the sense that a jackpot in a lottery may grow as enrollments increase; the games have no automatic means to adjust the parameters of the game to match the size or character of the player pool.

All current games require that players make their wagers in local or casino currency, or in a universally acceptable official currency. This limits play to those who possess or can acquire the currency of choice, and makes automatic transfer of credits between venues difficult. Most importantly, it means that a truly universal game, available accross national lines, can only be offered to players possessing acceptable currency: There is no universal mechanism for accepting wagers using a "neutral" medium of exchange which is not an official currency.

Yet another significant feature of current games is the dearth of winners, and the inability of players to influence the likelihood of their winning once play is underway. Winning in the lottery or other wagering games is often expressed in terms of the percentage of the total amount wagered which is returned to players; this is meaningless to the individual player, who is interested in his personal winnings.

OBJECTS AND ADVANTAGES

Accordingly, several objects and advantages of the present invention are:

Logic of winner selection is based on a "survivor" principle, which is the opposite of the single-draw method prevalent in current games. The game is divided into "rounds", one round for each position in the unique set of symbols assigned to each player. In each round, symbols are selected by random means until only one remains, that one advancing to the next round, and the selected ones being "retired". This increases the excitement of the draw and thus the enjoyment of the players, particularly since holders of both the surviving and retired symbol-sets have different options available to them.

The present game is multi-tiered. The game is so structured that retirement from one game simply qualifies a symbol-set for entry into the next, Thus the holders of retired symbol-sets may enroll in a subsidiary game constructed to utilize the remaining (non-selected) symbols. Each round spawns a new game, the ultimate number of games being equal to the number of positions in the symbol-set. Thus a five-position set requires five rounds to complete one primary and four subsidiary games. The identification of the survivor for the final position resolves all open games.

The game is so structured that it continues even after the final selection. Each player who has persisted through the final round is qualified to play a summary game for a major jackpot. The players enrolled in the summary game are polled, and select the surviving symbol, one position at a time, until the winning symbol-set is complete. If the winning set is not enrolled (that is, if the holder did not choose to enroll it in the summary game), then the jackpot is divided among the enrollees in a pre-established proportion which favors those players holding the largest number of enrolled and selected symbols. Thus players are motivated to continue play right through the end of the summary game, and have a significant probability of recovering more than the successive amounts wagered on the initial, subsidiary, and summary games.

The present game is structured to take advantage of data processing and communications technology to build player participation into the game. The player is enabled, but not required, to exercise certain options during the course of play, which will affect the outcome of the game. Participation includes the polling feature built into the summary game, and also includes:

An option to increase the amount wagered on assigned symbol-sets early in the game, which increases proportionately any winnings attributable to the set;

An option to accept the game-host's offer to buyback a surviving symbol-set, at any one of several points prior to game resolution, for a progressively increasing multiple of the original wager;

An option to sell all or part interest in a symbol-set to another enrolled player or players, employing an "auction" method;

An option to purchase unenrolled symbol-sets;

An option to engage in parimutuel betting;

These participation features give the player the opportunity to control certain elements of the game, and so increases his enjoyment as well as maintaining his high interest level.

The present game is structured to allow player-to-player interaction using data-processing and computing technology, and instant communications; such interaction includes the auction feature mentioned in the preceding paragraph, and also includes the capability to form "cartels" to pursue joint strategies, particularly in the summary game.

The present game is designed to be venue-independent, and to enable universal play. The player of the large-scale games may be present at a venue such as a casino; may access and play the game by remote means; or may delegate play to a proxy player or a "bot" operating in accordance with a protocol selected by the player in advance. This "universality" feature is facilitated by a game currency, which allows players to make wagers and economic decisions independent of official currency valuations or restrictions.

The present game is scalable in real-time. It utilizes data-processing and communications technology to assess the size and character of the player-pool, and to organize larger-scale games when sufficient players are available, regardless of site, communication modality or geographic considerations.

The present game is structured so that every persistent player has an opportunity to win a major jackpot right through the final summary game selection process. In fact, under certain conditions and with appropriate strategic decisions, every persistent player will participate in the ultimate jackpot. In the case of large-scale games, this possibility exists only due to unique mechanizations made possible by modern communications and data-processing technologies.

Other objects and advantages of this invention are provided by the combination of data-processing and communications technology, with the logic of the wagering game disclosed herein. These objects and advantages are largely enabled by the game's ability to track the player's situation as the game progresses, and to inform him of his situation, his options, and the strategies available to him, all this despite the ever-present scalability factor; that is, at selected point the game may be expanded to encompass increasingly larger numbers of players.

Further objects and advantages of this invention will become apparent from a consideration of the drawings and ensuing descriptions.

DRAWING FIGURES

Figure 4:
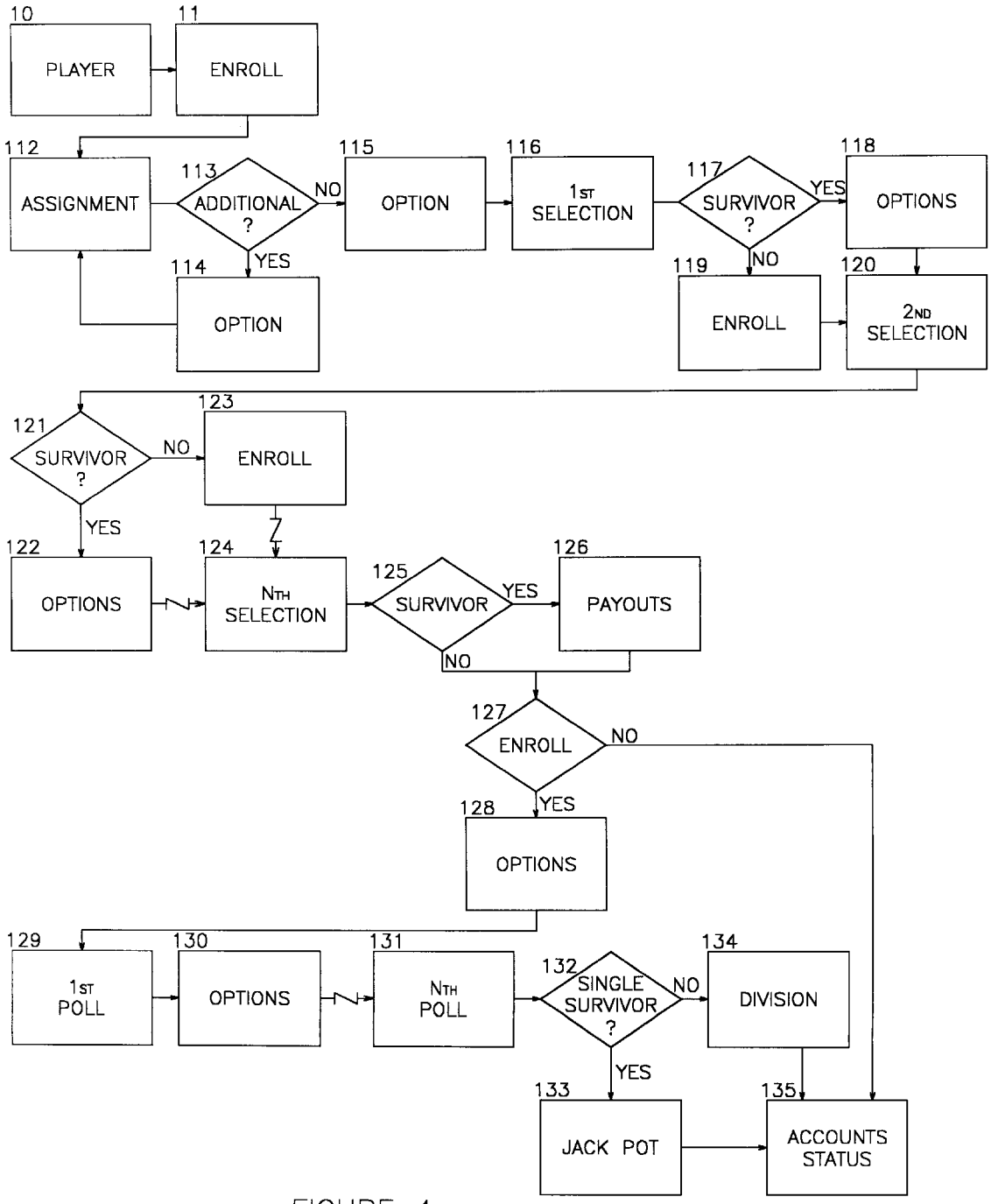

FIG. 4 defines the game logic.

REFERENCE NUMERALS IN DRAWINGS

10. Players
11. Enroll
12. Establish Account
13. Enable
20. Communications System
30. Game-host
40. Accountant
41. Account Status
112. Assignment
113. Additional Assignment
114. Option—Assignment Mode
115. Option—Increase Wager
116. First Selection
117. Survivor
118. Option Set
119. Second Enrollment
120. Second Selection
121. Survivor
122. Option Set
123. Third Enrollment
124. Nth Selection
125. Survivor
126. Payouts
127. Summary Enrollment
128. Option Set
129. First Poll
130. Option Set
131. Nth Poll
132. Single Survivor
133. Jackpot
134. Division

SUMMARY OF THE INVENTION

The present invention comprises a game and a system for implementing and controlling the game and its play on a local or extended basis. The game may involve elements of chance, skill and persistence, although it may be played successfully with little more than basic knowledge of the game's logic. Superficially the game is designed to resemble a lottery, but the principles governing its play depart dramatically from lottery methodology, to wit: The game is played in a series of rounds, culminating in a final round in which all persistent players may qualify for a payout, including a significant jackpot; players are retired from each round by means of successive selections of assigned symbols, with the survivors continuing in the game and the retirees being qualified for entry into a subsidiary game; successful players qualify for intermediate payouts, and all players who persist through the final selection round qualify to enroll in a summary game, in which all participants may receive a payout, and which is decided by a polling method in which players select the winner of the jackpot. The game is further embellished by providing the players with significant options, including a capability to enroll preferred playing symbols, a wager-increasing option, an opportunity to acquire unassigned symbols, a facility to enable auction of all or partial interest in a set of symbols, and a pari-mutuel feature.

The game is managed by a game-host which records all transactions, performs symbol-selection, certifies enrollments in all games, and maintains the status of each player's situation in the game and the options available to him. The game-host in supported by an accountant, a data-processing system which maintains the status of each player's capital position in real-time. Each player purchases game currency, and this currency is used to play the game, including the exercise of options. Payouts and jackpots are rendered in game currency, which may be converted to an official currency at the player's option.

The game is enabled by a multi-tiered communication system which provides real-time access to the game-host during play, and to the accountant, the control system which manages player accounts, and to other players.

Accordingly, it is a principal object of the invention to provide an improved, multilevel game organized to implement the principle that surviving symbol-sets advance progressively to a jackpot level, while retiring symbol-sets qualify to enroll in a subsidiary game, which may also lead to the jackpot level.

An additional object of the invention is to provide a game which can be played by any number of players simultaneously from any location in the world. A related object is to provide means to enable players to play by automaton or by proxy, when other considerations prevent the player's active involvement.

It is another object to provide options which enable players to increase the value of payouts, to profitably dispose of surviving symbol-sets, and to otherwise enhance the value, quality, and enjoyment of the game.

It is a further object to provide a system which permits the game to be played locally, and expanded at various levels through international, worldwide play, in real-time.

Still another object is to provide a distinct game currency, whereby players can translate any recognized official currency or items of economic value into the distinct game currency, and to account for game transactions in the latter. Players may transfer their holdings of game currency to any official recognized currency.

Yet another object is to provide a communication system including means for players to enroll in games from either local or remote sites. The system enables players to monitor play, to transmit their option decisions, and to monitor and control their account status.

Description—Main Embodiment

Figure 1:
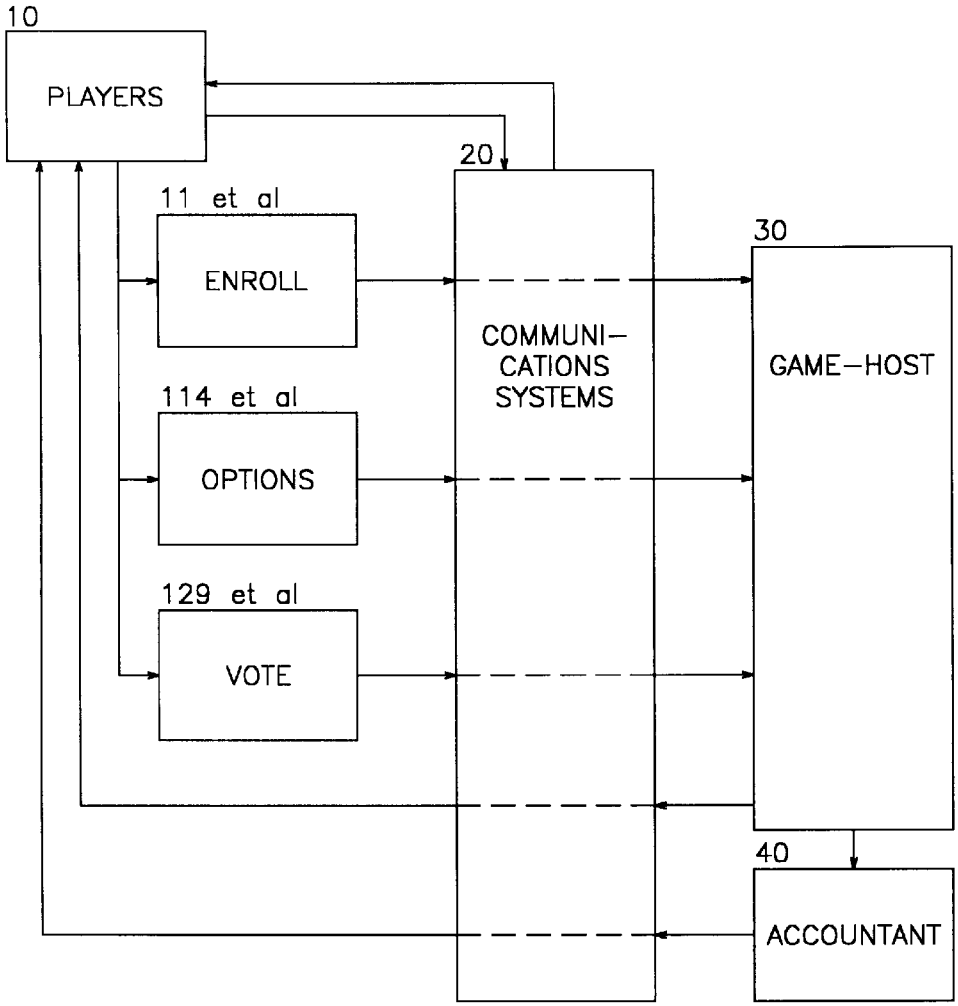
FIG. 1 depicts the invention's elements.

FIG. 1 shows the basic elements which make up the wagering system. Conceptually, there are three functional elements: A data-processing system which functions as game-host 30 or controller; a data processing system which functions as accountant 40; and a communications system 20 which links the game-host 30 and the accountant 40 with one another and with and with the players 10.

Figure 2:
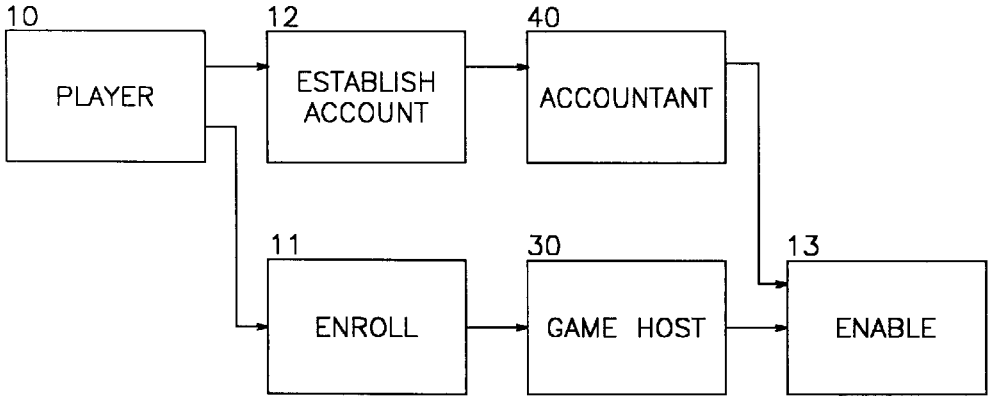
FIG. 2 illustrates the enrollment sequence.

FIG. 2 shows the process of enrollment 11. Enrollment is the means by which a player 10 is qualified by game-host 30; and during which player 10 establishes a game currency account 12. The player 10 is thus enabled 13 to play the game.

Figure 3:
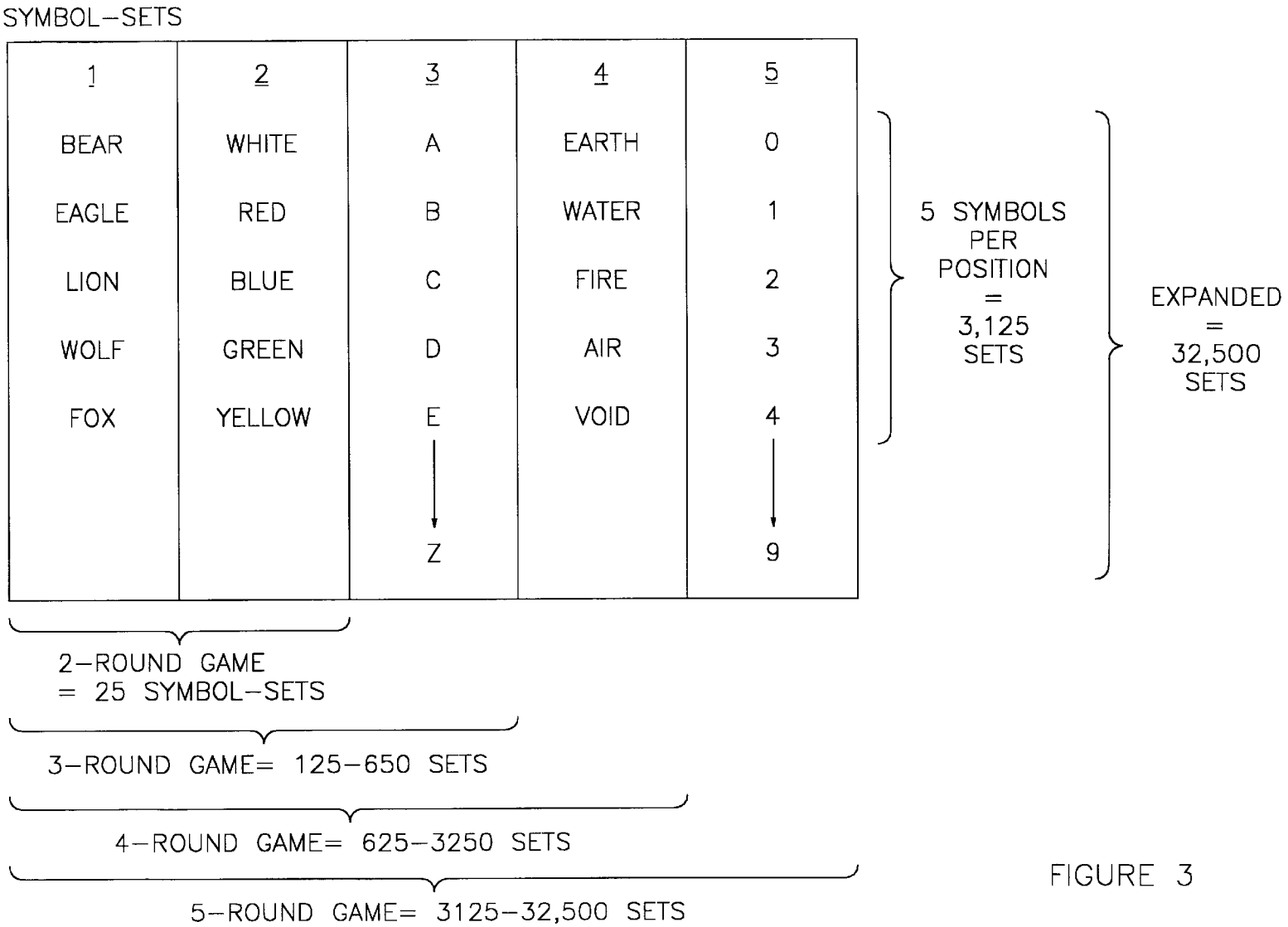
FIG. 3 shows the expandability of symbol-set quantities.

FIG. 3 illustrates the expandability or scalability feature of the game. The game may be played in two rounds or more, with no maximum number. A two-round game with five symbols per position can have a maximum of 25 assigned symbol-sets. The number of symbol-sets can be expanded vertically, by increasing the number of symbols within each set, or horizontally by increasing the number of positions. The five-position configuration illustrated on FIG. 3, when limited to five symbols in three positions, ten digits in one position, and 26 alphabet characters in another position, can have a maximum of 32,500 symbol-sets available for assignment. The sets available could be increased to 260,000 by expanding each five-symbol position to a ten-symbol position. Game logic does not vary, regardless of the quantity of sets assigned.

FIG. 4 describes the basic logic of the game, regardless of the number of rounds. Player 10 performs enrollment and is randomly assigned 112 a symbol-set. Player 10 may exercise option 113 to acquire additional symbol-sets, either randomly assigned or incorporating specific symbols or combinations. Player 10 may then exercise option 115 to increase his wager on any or all assigned symbol-sets. The first selection series 116 is then performed, which results in identification of the survivor for the first position of the symbol-set. The players holding the position 1 surviving symbol may then exercise one or more of the choices offered under options 118:

The acquisition of any remaining unassigned symbol-sets;

allow the host to buyback any surviving set for a premium;

auction of all or part-interest in any surviving symbol-set to other players; and pari-mutuel wagering on future occurences.

Non-survivors (retirees) of the position 1 selection process may enroll 119 in a subsidiary game.

The second selection series 120 results in identification of the survivor for the second position of the symbol-sets enrolled in both the original and subsidiary games. The survivor 121 may exercise the options 122, which are:

The acquisition of any remaining unassigned symbol-sets;

allow the host to buyback any surviving set for a premium;

auction of all or part-interest in any surviving symbol-set to other players;

and pari-mutuel wagering on future occurrences.

Retirees of position 2 selection may opt to enroll 122 in a subsidiary game.

This process continues until the nth selection series 124, the number defined by the number of positions in the symbol-set. The survivors 125 receive payouts 126; and all players who have persisted in the game through final selection have the option to enroll 127 in the summary game, using the same symbol-set(s) 112 employed in the preceding game(s).

In the summary game, survivors are elected by player polling. A player is allowed one vote per enrolled symbol-set. The first player poll results in identification of the survivor in the first position, and is followed by a set of options 130; these include an option to auction all or part interest in a symbol-set, pari-mutuel betting, and formation of cartels among players. A series of player polls ensues until the nth poll 131, n being defined by the number of positions in the set; with the same set of options available at the end of each poll.

If there is a final survivor 132 upon completion of polling, then the holder of that symbol-set receives the jackpot 133: If not, then the jackpot is divided 134. Payouts 135 are credited to player accounts.

Operation—Main Embodiment

The game begins with enrollment (FIG. 2). Enrollment 11 is the process by which participants are qualified by the game-host 30 and accountant 40. Qualification includes the purchase of game currency 12 and the provision of such information as is necessary for the future identification of the participant. Sufficient game currency 12 is purchased to enable play of at least one game, and an account is opened by the accountant 40 to enable recording of debits and credits. Upon completion of this process, the player 10 is enabled 13 to play the game.

Using game currency 12, player 10 purchases 112 a set of symbols selected by random means. Player 10 is then offered option 113 to purchase additional symbol-sets, and secondary option 114 to specify whether the additional symbol-sets shall be selected randomly or shall include designated symbols. Player 10 is then offered option 115 to increase his wager on any or all assigned symbol-sets, which if accepted qualifies player to receive proportionately-increased amounts on any payouts awarded to the designated symbol-set(s), including the jackpot award.

When symbol-set assignment is complete, the game-host 30 performs the first selection series 116. By pre-established means, game-host selects symbols, one at a time, from those symbols occupying the first position in the symbol-set, until only one symbol remains. The players holding the surviving symbol 117 are offered options 118. Options 118 include, but are not limited to:

An option to purchase any symbol-sets which contain the survivor 117 in the first position, which have not yet been assigned;

an option to allow Game-host 30 to buy-back any survivor 117 for a multiple of its original price which, if exercised, retires that symbol from the game;

an option to auction equity in a survivor 117 to other players;

and an option to engage in pari-mutuel wagering on the next symbol drawing, on the composition of the final surviving symbol-set, etc.

Players whose assigned symbol-sets did not survive the first selection series are offered enrollment in a subsidiary game 119.

Upon completion of the exercise of options and enrollments, game-host 30 performs the second selection series 120. By pre-established means, game-host selects symbols, one at a time, from those symbols occupying the second position in the symbol-set, until only one symbol remains. The players holding the survivor 121 are offered options 122. These are the same series of options defined as options 118, except that the value of the options have been affected by the progress of the game: That is, the buyback offer amount will vary, pari-mutuel odds will have been altered, and so forth. Players whose assigned symbol-sets did not survive the second selection series are offered enrollment in subsidiary game 123.

Play continues in this fashion through the nth selection series 124, n being defined by the number of positions in the symbol-set. The nth selection series resolves all open games; that is, it defines the surviving symbol-sets 125 of the original and all subsidiary games. All surviving symbol-sets receive a pre-determined payout 126. All persistent players, those who have continued in the game through the nth selection series, whether a survivor or not, are offered enrollment in the summary game 127. Players who choose not to enroll have their accounts for the game finalized by the accountant 40, and are notified of their current account status.

Enrollees in the summary game are offered options 128. These options include, but are not limited to: Auction of equity in specific symbol-sets; pari-mutuel betting on the summary game's outcome; and the formation of cartels to act in concert during the summary game.

Following completion of enrollment and the exercise of options, the game-host manages play of the summary game. The game-host conducts a first poll 129 of enrolled players, in which the holder of each enrolled symbol-set casts one vote for each symbol-set held. The first poll results in selection of the first symbol of what will become the winning symbol-set. In keeping with the survivor principle, the symbol with the lowest number of votes is the first position survivor. Following first symbol selection, players are offered options 130, which may include but are not limited to: Buyback by the game-host, pari-mutuel betting, and cartel formation. Following exercise of options, the game-host manages the next player poll.

The summary game continues in this fashion through the nth poll 131, which results in identification of the single surviving symbol-set 132, whose holder receives the jackpot 133. However, since symbol-sets have been retired through the course of the game, the surviving symbol-set may not have been or may no longer be enrolled; in which case, the jackpot is divided 134 among the enrolled players in pre-established proportions. Player accounts are adjusted and finalized 135 by the accountant 40.

It is obvious from the above description that the elements described in FIG. 1 are crucial to the game. Even if the game were played in a single venue, such as a casino or cruise ship or airliner, and thus were limited in scale, the elements identified on the figure are essential to the game. In limited venues, a single computer or data processing system may house the elements game-host and accountant, and may manage communications as well, but the use of certain constructs to house multiple elements is a matter of utility, of convenience and economics, rather than a necessity of the game. Thus the game may be seen to be "scalable", with a limited number of players per venue, but with the capability to accommodate very large numbers of players by linking venues. It is possible to play the game with thousands of venues, with, for example, the game elements at each venue linked to a "master" game-host.

Such a large game as implied in the preceding paragraph would require an expandable symbol-set, as illustrated in FIG. 3. The figure depicts a simple five-round game, with five symbols per position, and shows that this configuration yields 3125 unique symbol-sets. By increasing the third symbol position to encompass the 26 letters of the English alphabet, and the fifth symbol position to encompass the ten single-digit Arabic numerals, the quantity of available symbol-sets is increased from 3125 to 32,500. This five-position configuration can continue to be increased by adding more symbols to each position. The quantity of symbol-sets can also be expanded by adding positions: It can be readily calculated that the addition of a sixth and seventh position to the expanded five-position set of FIG. 3, each new position with ten symbols, would expand the available symbol-sets to 3,250,000.

"Scalability" also refers to the dynamic factor which enables the game to grow in capacity as the size of the player-pool increases. That is, games may begin as, say, three position games at local venues. As players enroll in the local game, they may trigger its expansion to a four- or five-round game. Under pre-established conditions, the local game-host notifies the master game-host that it is available to join a larger game. The master game-host queries all active venues to determine the size of the total player pool available; activates a pre-established protocol which enables all available players to enroll either directly or through their local venues; manages the expansion of symbol-set assignments to avoid duplication; and when enrollment is complete, begins play of the game. Play is managed as previously defined.

As an aid to players, game-host continually updates game status on an individual display device, which informs players of the current situation of each assigned symbol-set, the options available, current jackpot size, etc. For example, the game-host provides current pari-mutuel odds on any symbol or combination wager; and maintains status of available buybacks and their value; and of other values which may vary as the game progresses.

The accountant maintains the status of the player's account throughout the game. If the account reaches a pre-established point at which the player does not own sufficient game currency to exercise any options available to him, the player is notified of same; if he does not respond by increasing his game currency account, then the accountant notifies the game-host and a least-cost protocol is activated. The player remains in the game, but his options are restricted. Upon completion of the game, the accountant provides each player with the current status of his game currency account.

Referring further to game currency, this is the mechanism which enables the game to achieve universality. Players who do not have ready access to freely-exchanged currencies may still enroll in the game, through a local venue, exchanging local currencies or other items of economic value for game currency.

Players who do not have access to a local venue, either personally or by use of a network or an enabled communication device or the like, may still play the game. Two methods are provided. First, when registering, the player may select a protocol by means of which a game-host may play the game for the player: In fact, the player pre-selects the options to be exercised as the game progresses, and the game-host, acting as a "bot", automatically applies those insructions. The second method is to play by "proxy": That is, the player selects an actual person certified by a casino or the like as a qualified individual, and the proxy plays the game as the player. Proxy compensaton is by standard pre-arrangement.

In addition to the data processing capabilities described, the game is made possible by communications technology. Since the game requires that players be in regular, two-way communication with the game-host and others, the game must make use of communications means which enable this facility. When the Same is played in a local venue, the communication system may be hard-wired to each player's location, or may utilize a wireless local network. For remotely located players, the communications system may be related to the internet or a like network, or may be a dedicated local or universal intranet; or it may be any combination of technologies which permit players, wherever located, to have two-way communication with the game-host and the accountant, and with one another.

Description and Operation—Alternative Embodiments

The game may also be implemented on a stand-alone machine, similar to the slot and game machines in present casinos. A three-round game, for example, might be offered on a playing machine presenting most of the features described above, except those involving player interaction. For the summary game, for example, polling might be replaced by a random selection method. In addition to its obvious entertainment value, this stand-alone game might be used as a training device for new players.

Similarly, a version of the game can be played on a personal computer or similar dedicated device. This could be particularly useful for players wishing to develop strategies for playing the hosted games, and for improving the player's use of the options associated with the game.

A board-game version of the invention will make an exciting parlor game. It could be played by two or more participants, and could offer all of the features of the larger games except, of course, scalability. It would be limited to players present and to a small number of rounds, say three or four, although larger numbers of rounds could be employed to develop significant jackpots.

Thus it may be seen that the game provides a challenging and enjoyable experience. The multi-option, multi-tier logic built into the game makes it particularly attractive to persons who have played computer-driven games or even casino games such as craps, which present players with choices as the game progresses. It also offers a new level of challenge for players of such traditional games as bingo or lotteries. And its judicious use of data processing technology enables the presentation of options and choices to players in a singular, straightforward manner; and with sufficient dispatch to maintain the pace of the game. Each choice is simple, but the sophisticated player can find ways to execute complex strategies.

While the above description contains many specificities, these should not be viewed as limitations on the scope of the invention, but rather as an exemplification of the several embodiments described. Many other variations are possible. For example, a version might define the third (or any other) symbol selected in each position as the "survivor"; and payouts and jackpots might be fixed, rather than varied in the course of the game.

Accordingly, the scope of the invention should be determined not by the embodiment(s) illustrated, but by the appended claims and their legal equivalents.

Conclusion, Ramifications and Scope

Thus the reader can see that the wagering game of this invention, and its implementing system, provides a highly entertaining experience and is a significant technological advance over current casino systems. The survivor principle, as utilized here to identify winning sets of symbols, and particularly its mechanization by player polling, is an effective means for increasing suspense, player participation, and enjoyment of the game.

While my above description contains many specificities, these should not be construed as limitations on the scope of the invention, but rather as an exemplification of one preferred embodiment thereof For example, the computation functions can be combined in a single machine, which might also control communications: The precise operating elements employed to support the game may vary, and in fact will evolve rapidly, but the principles of the game and the logic of play remain. Likewise the communications element: Today's game utilizes a mix of direct lines, internet or intranet access, a telecom system linking active venues, etc; but obviously wireless comunication will be utilized as it evolves, and other modalities will follow.

Another variation envisions the development of a cadre of players "permanently" enrolled with, say, a master game-host, and who enter a game when certain preconditions are met: For example, when a jackpot above a certain threshhold is projected. Such players might have certain symbols or symbol-sets permanently assigned. There might be games dedicated for the play of such cadres, or they might be offered some form of preference in exchange for their permanent enrollment.

The options available to survivors of each round could be expanded in various ways; for example an option to wager on the final value of the jackpot, or on whether there will be a single jackpot winner or it will be divided. The expansion of options would create a situation similar to craps, where players have multiple betting options.

Another variation might involve expanded cartel formation. Cartels might be formed like mutual funds, whereby players could designate a manager to bet and or play for a group of players, and share the proceeds in a predetermined way.

The game currency account can be made "permanent", and can serve many purposes besides its basic function of game facilitation. For example, it might serve as the basis for a credit line or credit card which could be used for predetermined purposes. Such a facility might be used to enhance the formation of cadres, as mentioned above. It might even result in the development of a medium of exchange for use in the game communty.

Another variation would be to use the gaming network as configured here to host traditional casino games, for example to fill the time while waiting for the start of a game. Similarly, the network might serve as an advertising or information channel.

While the game derives some of its unique character from the survivor principle and the player polling mechanism, among other features, another symbol selection variation might be to mix these techniques with more traditional sequences, such as making the first (or any other) selection the winner. These techniques might be used at intervals, or mixed, or invoked in a predetermined way, to impart further suspense to the game.

I claim:

1. A wagering game in which a player enrolls in a predefined manner and, upon enrolling, is assigned a unique set of symbols (symbol-set), said symbol-set consisting of a combination of commonly-recognized unique indicia such as; numerals, alphabetical characters, animal figures, names of precious metals or gems, colors or their names, household objects or other common unique indicia subject to differential characterization, said symbol-sets ordered in a predetermined progression determined by a position, such as numerals in the first position, alphabetical characters in the second position, then animal figures in the third position, and so forth;

the wagering game proceeding by addressing, one position at a time, each position in the predetermined progression, and selecting, by predetermined means, said unique indicia one at a time from a collection of unique indicia assigned to that position until only one unique indicia remains unselected in each position, thereby identifying said unique indicia from the symbol-set assigned to the player which has survived the selection process; and whereby the player assigned said unique indicia is identified as a winner of the wagering game for the first position, the winner being eligible to continue playing the wagering game in the next position of the predetermined progression.

2. The wagering game of claim 1 wherein the unique indicia utilized to construct the symbol-sets consist of one or more unique indicia of a specific class, such as numerals or alphabetical characters, and which may be repeated as necessary to populate a predetermined number of positions; whereby a defined plurality of unique indicia, such as the numerals "0" through "9", serves as the basis for an unlimited number of symbol-sets, and thus enables an unlimited number of players to participate in the wagering game.

3. The wagering game of claim 1 wherein the wagering game may comprise adjustment means for the symbol-set assigned to the player by adding one or more positions to an extant sequence, and by assigning a symbol, selected by predetermined means, to each position so added;

the adjustment means enabling the following actions;

whereby an unlimited number of players are enabled, under specified conditions, to enroll in a wagering game in progress which may be expanded to accommodate their participation;

whereby two or more wagering games in progress may be combined; the symbol-sets in the expanded or combined wagering games may be adjusted by the adjustment means so as to avoid duplication of symbol-sets in the combined or adjusted wagering games.

4. The wagering game of claim 1 where the symbol-sets which include the selected unique indicia are not eligible to continue to participate in the wagering game, become eligible to participate in a secondary derivative wagering game in which the player's assigned symbol-set, less the selected unique indicia, may be enrolled; and which is played simultaneous with the initial wagering game, with the unique indicia selection proceeding on the next position of the predetermined progression of the symbol-set, and with the effect that the unique indicia selection for the second position in the initial game also constitutes the unique indicia selection for the first position of the secondary derivative game; this same process continuing by resolving the surviving unique indicia each by the unique indicia selection for each position in the predetermined progression, with the symbol-sets characterized by the selected unique indicia qualifying for derivative games—tertiary, quartiary, and so on, until the unique indicia selection for the final position for the initial wagering game; thereby resolving the initial and all derivative wagering games by identifying the surviving symbol-set for each game, and thus identifies the players assigned the surviving symbol-sets as the winners of the wagering games in which those symbol-sets are finally enrolled.

5. The wagering game of claim 4 in which all symbol-sets which are enrolled through final symbol selection are eligible to enroll in a summary wagering game, in which the technique of player polling is utilized to select a surviving unique indicia for each position, one position at a time, until the poll for the final position completes the identification of the surviving symbol-set, and thus identifies the player assigned that symbol-set as the winner of the summary wagering game; where players who persist in their enrollment throughout the course of the wagering game receive the opportunity to participate in the summary wagering game.

6. The wagering game of claim 5 in which the symbol-set selected by the defined player-polling technique is not assigned to an enrolled player, resulting in a predefined payout being divided among the enrolled players in predetermined proportions; whereby players may pursue a strategy in which each player seeks to participate in the summary game payout, rather than seek a singular win-or-lose result of the wagering game or the derivative games.

7. The wagering game of claim 1 in which players may exercise defined options during the course of play which options allow players to pursue preferred strategies or to wager on specific unique indicia or symbol-sets which they may not have been assigned during the enrollment process including;

the player may increase his wager on the symbol-set assigned to him, by a predetermined amount, at designated points in the game; whereby a player may seek a larger return for a wager on a preferred symbol-set;

the player may retire a symbol-set from the wagering game, in exchange for receiving a specified multiple of his enrollment fee for that symbol-set, said multiple increasing as the game progresses;

the player may accept a fixed return rather than risk an uncertain result;

the player may offer other players equity in his assigned symbol-set, by auction or direct negotiation, at specified points in the progress of the wagering game;

the player may allow other players the opportunity to share prospective winnings;

the player may participate in pari-mutuel wagering on predefined events in the wagering game, such as;

the likelihood that a specific unique indicia will be selected at a specified point in the selection process;

the likelihood that the specific unique indicia will not be selected, and thus will survive to become pert of the symbol-set which wins the wagering game;

the likelihood that a specific symbol-set will not be selected, and thus will win the wagering game.

8. The wagering game of claim 1 wherein the means for unique indicia selection is by polling of the enrolled players (player-polling), in which each player designates the unique indicia to be selected for each position, or for a designated position such as the final position, acting in the knowledge that the selected unique indicia will be retired from the game; whereby each player directly influences the outcome of the game, by affecting the likelihood that certain unique indicia will be retired while others unique indicia will survive.

9. The wagering game of claim 1 in which said game is hosted on a device such as a digital computer, the physical location of which is not relevant to play of the game, nor necessarily known to the players, and thus is known as a "virtual wagering game"; and in which a plurality of communications means may be employed to link players with said virtual wagering game, such communications means including all publicly accessible modalities, from the group consisting of pagers, satellite terminals, telephones, wireless phones, internet and e-mail; and such predefined private modalities as the players may elect to utilize; whereby a geographically-diverse corpus of players may participate in the wagering game without constraints of location, cultural communications preferences, or local technology limitations.

10. The wagering game of claim 1 in which players may select, from a predetermined set of potential choices, a sequence of choices which permit the wagering game to be played for the player by a third party or by an automaton such as a computer program, said third party or automaton executing each pre-selected choice at the appropriate point in the wagering game; whereby players can participate in said wagering game without being either physically or virtually present at any particular site, or without being in direct communication with any party to the wagering game, during the course of the game.

11. The wagering game of claim 1 in which players from multiple and diverse jurisdictions are enabled to participate in the wagering game by establishing a game currency account, in which said players may deposit local currencies, or other acceptable items of economic value, which are convert ed to game currency at predetermined or negotiated rates; and players may utilize the game currency balance in said game currency account to enroll and otherwise participate in said wagering game; whereby players in any place of residence or location, permanent or transient, are enabled to participate in the wagering game.

12. The wagering game of claim 1 in which symbol-sets not otherwise assigned, may be enrolled by players who may seek to be assigned symbol-sets containing or comprised of certain unique indicia or unique indicia combinations preferred by the players; whereby players are enabled to hold a multiplicity of symbol-sets in a particular game, and to enroll additional symbol-sets in order to pursue preferred strategies for participation in the wagering game.

13. I claim a wagering game with the following:

means to enable players to enroll with a defined game-host;

means to assign unique indicia, selected by predefined means from predefined universes of unique indicia, to enrolled players, and to array assigned unique indicia in a symbol-set in a predetermined order such that each unique indicia occupies a position in the array reserved for that universe of unique indicia; means to select unique indicia, position by position, retiring each unique indicia selected, until one unique indicia remains unselected per position, the totality of unselected unique indicia defining the surviving symbol-set, the player assigned that surviving symbol-set being the winner of the wagering game;

means to utilize symbol-sets enrolled in the wagering game, but retired by virtue of having a unique indicia selected, are utilized to create a derivative secondary wagering game, played in like manner; and symbol-sets retired from the secondary wagering game utilized to create a derivative tertiary game, played in like manner; with this process of derivative game creation continuing until identification of the final surviving unique indicia of the first wagering game is accomplished; and wherein such final unique indicia identification resolves the original wagering game and all of the wagering games derived from it;

means to communicate predetermined types of information between and among enrolled players, and between players and the host of the wagering game, including a set of instructions promulgated before the wagering game begins, by use of which a designated agent of the enrolled player may, by adhering to the set of instructions, play the game as a proxy for the enrolled player;

means to enroll players in a summary wagering game, for participation in which players will have qualified by persisting in the original wagering game or any of the derivative wagering games through final unique indicia identification in those games, and in which the summary wagering game is resolved by polling the enrolled players to select unique indicia to be retired, such selection proceeding position by position, with the unique indicia receiving the fewest votes being the surviving unique indicia for each position, the symbol-set so defined being the winning symbol-set for the summary game; means to distribute the payout for the summary game to the enrolled players, in predetermined proportions, in the event that the surviving symbol-set is not assigned to an enrolled player;

means for players to exercise predetermined options during the course of the initial and derivative games, from the group consisting of: increasing wagers on assigned symbol-sets, agreeing to retire assigned symbol-sets in return for a specific and predetermined multiple of the fee paid to enroll said symbol-sets, auctioning all or part of the equity in an assigned symbol-set to other parties, and pari-mutuel wagering on predefined eventualities which might occur dining the course of the wagering games.

* * * * *